United States Patent [19]

Zurbuchen

[11] 4,274,829

[45] Jun. 23, 1981

[54] CONTINUOUS DYEING PROCESS IN ORGANIC SOLVENT VAPORS

[75] Inventor: Jacques Zurbuchen, Pratteln, Switzerland

[73] Assignee: Ciba-Geigy Corporation, Ardsley, N.Y.

[21] Appl. No.: 948,620

[22] Filed: Oct. 4, 1978

Related U.S. Application Data

[63] Continuation of Ser. No. 664,450, Mar. 8, 1976, abandoned.

[30] Foreign Application Priority Data

Mar. 14, 1975 [CH] Switzerland ..... 3263/75
Apr. 3, 1975 [CH] Switzerland ..... 4222/75

[51] Int. Cl.[3] ..... D06P 1/68

[52] U.S. Cl. ..... 8/475; 8/614; 8/648; 8/662; 8/675; 8/921; 8/922; 8/924

[58] Field of Search ..... 8/174, 94 A, 94, 1 W, 8/475, 614, 648, 662, 675, 921, 922, 924

[56] References Cited

U.S. PATENT DOCUMENTS

| | | | |
|---|---|---|---|
| 3,393,210 | 7/1968 | Speck | 260/31.2 N |
| 3,667,898 | 6/1972 | Bergman et al. | 8/94 |
| 3,762,872 | 10/1973 | Acree | 8/176 |
| 3,926,554 | 12/1975 | Schulerer | 8/174 |
| 3,988,109 | 10/1976 | Schulerer | 8/74 |
| 4,121,899 | 10/1978 | Chambers et al. | 8/94 A |
| 4,194,881 | 3/1980 | Birke et al. | 8/474 |

FOREIGN PATENT DOCUMENTS 1230924 5/1971 United Kingdom .

OTHER PUBLICATIONS

Anderson, N. L. and Carbone, J. N., J. Soc. Dyers and Colourists, Oct. 1973, pp. 378–379.

Anderson, N. L. and Carbone, J. N., AATCC Symposium: Textile Solvent Technology, Jan. 1973, pp. 65–71.

*Primary Examiner*—A. Lionel Clingman

*Attorney, Agent, or Firm*—Edward McC. Roberts

[57] ABSTRACT

Process for the continuous dyeing of synthetic fibre materials from organic solvents, wherein the material, preheated to at least 100° C., is impregnated with a halogenated hydrocarbon impregnating liquor containing dyestuff or optical brightener to give a liquor absorption of more than 100%, and is then passed through a vapor zone filled with halogenated hydrocarbon at a temperature above the boiling point of the halogenated hydrocarbon in such a manner that during passage of the material through this zone the liquor becomes concentrated on the material, whereby (a) the amount of solvent on the material is not increased by condensation of halogenated hydrocarbon vapor, and (b) more than 5% of liquor is present on the material when it emerges from the vapor zone, so that the material during its passage through this vapor zone never becomes dry.

18 Claims, No Drawings

CONTINUOUS DYEING PROCESS IN ORGANIC SOLVENT VAPORS

This is a continuation of application Ser. No. 664,450 filed on Mar. 8, 1976 now abandoned.

The present invention relates to a continuous process for dyeing synthetic fibre materials from organic solvent vapours, as well as to the synthetic fibre material dyed by this process.

Various attempts have been made to continuously dye, in a manner analogous to that in the case of the known aqueous Thermosol process, in particular polyester fibre material by pad dyeing from an organic liquor, such as perchloroethylene or trichloroethylene, with subsequent drying and recovery of the solvent, followed by a heat treatment to fix the dyestuff. The fixing of the dyestuff presents, however, special problems with regard to drying and migration. It has also been suggested to dry and fix simultaneously in one operation by the use of superheated solvent vapours, a process which, compared with the conventional Thermosol process entailing a separate thermal fixing treatment, would be more simple in its application. It would have to be taken into account, however, that perchloroethylene vapour, in consequence of commencing thermal decomposition, should not be heated above 150° C. Although some dyestuffs exhibit, under comparable time and temperature conditions, a better degree of fixing in perchloroethylene vapour than in hot air, fixing at 150° C. has hitherto never been complete, so that it has not been possible to attain the dye yield of a "conventional" hot-air Thermosol treatment at 200° to 210° C. It has also been attempted to use, as a fixing medium, vapours of compounds thermally more stable than perchloroethylene (such as ethylene glycol), a procedure, however, which introduces problems concerning the apparatus and the technical aspects of carrying out the process.

There has also been suggested a process wherein the dyestuff in an organic solvent or solvent mixture is padded onto the fibre material, and the fibre material is subsequently passed for 10 to 180 seconds through a zone filled with hot solvent vapour, in order to evaporate the solvent and to fix the dyestuff. The disadvantage of this mode of operation is that the fixing values of the dyestuff are inadequate.

Furthermore, it has not been hitherto possible at all to dye polyester textured knitted fabrics by the Thermosol process on account of the high fixing temperature of above 160° C., since the texture effect at this temperature is to a great extent lost.

The process according to the invention now overcomes these disadvantages. The process is characterised in that synthetic fibre materials, especially fibre materials made from linear high-molecular polyamide fibres as well as polyester materials, preferably polyester textured knitted fabrics can be dyed continuously, with a very high degree of fixing, from organic solvent vapours, preferably perchloroethylene vapours, if the material, preheated to a temperature of at least 100° C., is impregnated with a halogenated hydrocarbon impregnating liquor containing dyestuff or optical brightener to give a liquor absorption of more than 100%, and is then passed through a vapour zone filled with halogenated hydrocarbon at a temperature above the boiling point of the halogenated hydrocarbon in such a manner that during passage of the material through this zone the liquor becomes more concentrated on the material, whereby (a) the amount of solvent on the material is not increased by condensation of halogenated hydrocarbon vapour, and (b) more than 5% of liquor is present on the material when it emerges from the vapour zone, so that the material during its passage through this vapour zone never becomes dry.

It is now possible with this process to evenly dye in particular polyester textured knitted fabrics continuously and below 160° C. and linear high-molecular polyamide fibre materials below 150° C. and to obtain a good dye yield and very good fastness properties. Also closely woven fabrics, such as gabardine and satin, can be dyed even better than was hitherto possible in water.

Compared with an aqueous treatment, the treatment of linear high-molecular polyamide fibre materials in chlorinated hydrocarbon has the great advantage that a full silk-like handle is obtained, and even the material is stabilised.

The problem of dyestuff fixing in organic solvent vapours, especially in perchloroethylene vapours, is largely solved by the process according to the invention. This process moreover renders possible an improvement of the degree of fixing of about 30 to 50%, compared with that obtained with prior known processes. Since in this process the material is treated wet-on-wet, i.e. without intermediate drying, there is on the one hand prevented the risk of dyestuff migration, and on the other hand there is a saving of an operation (intermediate drying).

Superheated halogenated hydrocarbon vapour, especially perchloroethylene vapour, extracts from the synthetic fibre material the applied perchloroethylene and dries the fibre material. Fixing of the dyestuff ceases with the removal of the perchloroethylene. The absence of a transport medium for the dyestuff prevents penetration of the dyestuff into the fibres.

Compared with saturated solvent vapour, the superheated solvent vapour indeed has the advantage that the heating up of the colder fibre material laden with dye liquor to the boiling temperature of the solvent occurs rapidly in a superheated atmosphere. This temperature remains constant until the whole amount of the solvent has evaporated off from the fibre material. Only then does the temperature of the fibre material rise to the temperature of the superheated vapour. The superheated vapour, e.g. at a maximum temperature of 145° C. in the case of perchloroethylene, is in a gaseous state, with the proportion of saturated perchloroethylene vapour decreasing more and more with increasing superheat temperature. On a fibre material that has been preheated to at least 120° C., padded and dried, however, the dyestuff undergoes practically no fixing when subsequently treated in superheated perchloroethylene vapour.

It is for this reason important that drying of the synthetic fibre material laden with dye liquor is prevented in the vapour zone where fixing occurs by ensuring that the organic solvent is always present in sufficient quantity on the fibre material. The fixing conditions are ideal only as long as the organic solvent is present as a transport medium for the dyestuff on the surface of the fibres. In combination with the application of an adequate amount of liquor, the superheated organic solvent vapour prevents condensation on the material, and in particular in the equipment, and ensures that fixation of the dyestuff on the fibres can occur from a very short liquor under optimum conditions.

A partial or complete drying of the fibre material in the superheated organic solvent vapour is prevented according to the present invention by the synthetic fibre material being introduced with a sufficiently high proportion of liquor into the vapour zone. It is for example possible by means of slop-padding to apply to the fibre material liquor amounts of about 200 to 400%, with care being taken to ensure that, depending on the quality of the synthetic fibre material, the liquor is applied in such a manner that it does not drip from the material. In the case of textured knitted fabrics it is moreover of advantage and frequently necessary to effect such high applications of liquor, since otherwise an uneven absorption and wetting occur.

The process according to the invention, which is performed in continuous apparatus, such as in continuous steamers, can be carried out, for example, as follows:

The synthetic fibre material is heated continuously, e.g. by means of hot air, to a temperature of at least 100° C., advantageously 120° C., and the organic dye liquor, containing at least one disperse dyestuff and halogenated hydrocarbon, especially perchloroethylene, is applied, preferably by means of a slop-padding roller, in a sufficient quantity to the preheated material, so that the material is evenly impregnated with the liquor without being dripping wet. The temperature of the liquor is advantageously about 80° C., to at most 90° C. The material impregnated with a liquor absorption of over 100% is then passed immediately into a vapour zone filled with superheated solvent vapour and containing advantageously the same solvent as that present in the liquor.

By virtue of the vapour temperature, which is higher than the boiling point of the halogenated hydrocarbon, solvent is removed by evaporation from the applied liquor. Since the solvent evaporates off, a concentration of the liquor on the material occurs. The solvent vapours forming in this manner are reheated in special superheaters to a temperature higher than the evaporation temperature. Since the liquor absorption is higher than 100%, the vaporising process during the time of passage through the zone and fixing is so regulated that, although there occurs a liquor concentration on the material, the material does not become dry, with sufficient halogenated hydrocarbon remaining on the material as it leaves the steamer. The fixing times with this procedure are usually, depending on the depth of colour, between 1 and 20 minutes. An eventual subsequent washing of the dyeings obtained can be carried out in the usual manner for polyester, or in continuous solvent-scouring apparatus with halogenated hydrocarbon, since with the above-mentioned procedure only small amounts of unfixed dyestuffs have to be washed out.

After drying in normal drying aggregates, the residual halogenated hydrocarbon remaining in the fibres is completely expelled by azeotropic distillation effected by a brief passage of the dry material through saturated steam, and the material can thus be further processed in the usual manner.

The dyeings obtained by this process are outstandingly level and excellently dyed throughout. The dyeings in general have very good fastness properties such as fastness to wet-processing and to dry-processing, since an almost 100% fixing of the dyestuffs is achieved. In particular, the fastness to rubbing after this vapour treatment is better than that in the case of the aqueous Thermosol process.

The liquor absorption is advantageously between 100 and 400%, preferably between 150 and 300%, relative to the dry weight of the fibre material.

The temperature of the superheated solvent vapour depends on the halogenated hydrocarbon used, and is between about 122° and 180° C. For the preferred perchloroethylene, the treatment temperature in the superheated vapour is between 125° and 145° C.

The time of treatment in the solvent vapour can be between 1 and 20 minutes, preferably between 3 and 10 minutes.

Where perchloroethylene is used as the halogenated hydrocarbon, the fibre material is preferably preheated to a temperature of at least 120° C., whereas the temperature of the liquor on application should not be above about 90° C., preferably not above 80° C.

Halogenated hydrocarbons are suitable as dye liquor for the process according to the invention, particularly halogenated lower aliphatic hydrocarbons, especially those having a boiling point of between 60° and 180° C., such as chloroform, carbon tetrachloride, dichloroethane, tetrachloroethane, perchloroethane, 1,1,2-trichloro-2,2,1-trifluoroethane, dibromoethylene, 1- or 2-chloropropane, dichloropropane, trichloropropane, chlorobutane, 1,4-dichlorobutane, 2-chloro-2-methylpropane or dichlorohexane; or aromatic chlorinated or fluorinated hydrocarbons, such as chlorobenzene, chlorotoluene and benzotrifluoride. Particularly valuable are lower aliphatic chlorinated hydrocarbons boiling between 70° and 130° C., such as trichloroethylene, 1,1,1-trichloroethane, and especially tetrachloroethylene ("perchloroethylene"). Also mixtures of the halogenated hydrocarbons mentioned are suitable.

The dyestuffs to be used according to the invention are preferably disperse dyestuffs, which can belong to the widest variety of constitution types, such as azo, particularly monoazo and disazo dyestuffs, azomethines, stilbene derivatives, naphthoquinone derivatives and anthraquinone derivatives, and the most varied heterocycles such as quinophthalone, perinone, oxazine and phthalocyanine dyestuffs. Also suitable are nitro, nitroso, styryl, azamethine, polymethine and azostyryl dyestuffs. It is also possible to use metal-complex dyestuffs of copper, nickel, chromium, cobalt, iron and aluminium, which have affinity for synthetic fibres and correspond in character to the disperse dyestuffs. The dyestuffs may if desired also carry reactive groups.

Preferred dyestuffs are metal-free mono- or disazo dyestuffs, nitro dyestuffs, methine dyestuffs and anthraquinone dyestuffs.

By dyestuffs are also meant disperse optical brighteners, e.g. brighteners from the coumarin, azole or naphthalamide series.

The dyestuffs usable according to the invention are known and can be produced by known methods.

The amounts in which the disperse dyestuffs are used in the organic dye baths according to the invention can vary, depending on the depth of colour desired, within wide limits; in general, amounts of 0.001 to 10 percent by weight of one or more of the dyestuffs mentioned, relative to the material to be dyed, have proved advantageous.

If disperse dyestuffs soluble in boiling perchloroethylene are used, then the normal commercial dyestuffs in a suitable formulation can be employed. If the dyestuffs are present at least partially in the dispersed state in the organic dye liquor, then the addition of suitable dispersing agents is advisable.

It is advantageous to use disperse dyestuffs that are difficultly soluble in boiling perchloroethylene and contain a dispersing agent soluble in polyhalogenated lower aliphatic hydrocarbon, but which do not solubilise the disperse dyestuff. Particularly preferred are disperse dyestuffs having in boiling perchloroethylene a solubility of at most 0.05, preferably 0.03, percent by weight, and a particle size of at most 5$\mu$, preferably of between 0.1 and 3$\mu$.

It has proved advantageous to use the disperse dyestuffs in the form of dyestuff preparations, such as is described, for example, in the Belgian patent specification No. 791,517. These contain, for example, a dispersing agent, such as a modified polyvinylpyrrolidone (Antaron V 216), and a hydrocarbon soluble in halogenated hydrocarbons and boiling above 200° C., such as paraffin oil.

The process according to the invention is suitable for dyeing synthetic fibre material of the widest variety, such as fabrics, knitted goods, fleeces and tow, also in admixtures with natural fibres, in the most varied stages of processing, by a continuous method known per se. Suitable materials are, in addition to the partially synthetic fibres such as cellulose-2½-acetate and cellulose triacetate, especially fibre materials made from fully synthetic polyester, such as linear high-molecular esters of aromatic polycarboxylic acids with polyfunctional alcohols, for example those from terephthalic acid and ethylene glycol or dimethylolcyclohexane, and mixed polymers from terephthalic acid and isophthalic acid and ethylene glycol.

Mixtures of the fibres mentioned, particularly mixtures of cotton or wool and polyester fibres, are also suitable.

The application of the process to polyester textured knitted fabrics, the continuous dyeing of which has hitherto not been possible at all, is exceptionally suitable.

The present invention is especially suitable for dyeing silk-like fibre material made from linear high-molecular polyamide containing to the extent of at least 90% by weight of the recurring unit of the formula (I)

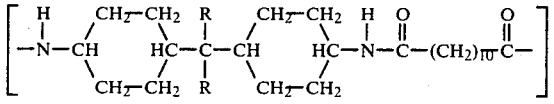

wherein in each cyclohexyl ring one of the hydrogen atoms may be substituted by a methyl group and each R independently represents methyl or preferably hydrogen.

These are preferably polyamide fibres of the above general formula I in which at least 40 percent by weight of the diamino constituent of the recurring unit possesses the trans-trans-sterioisomeric configuration, and particularly the polyamide polycondensate of 4,4'-diaminocyclohexylmethane with decamethylenedicarboxylic acid.

The manufacture of the polyamide fibres of the formula I which are usable according to the invention is described in U.S. Pat. No. 3,393,210. Such fibre materials are obtainable commercially in different qualities depending on finish, Denier number, etc.; they are obtainable from DuPont as Polyamide Type 472 and 473 and as Qiana (registered trademark). These last-mentioned fibre materials have a silk-like handle, a density of 1.04 and a crystallinity similar to that of polyester fibres, as given in the article "The Dyeing of Synthetic Polymer Fibers" by A. Liddiard in the Journal of the Society of Dyers and Colorists, Vol. 1, p. 64, June 1967—September 1969.

It is further disclosed in the U.S. Pat. No. 3,393,210 mentioned above that the polyamide fibres can be dyed under pressure in the presence of carriers which are normally used with polyester fibres, at temperatures of between 115° and 120° C., with disperse dyestuffs.

It is also mentioned in the stated article of Liddiard that polyamides of DuPont Type 472 can be dyed with disperse dyestuffs at the boiling point of the dye liquor in the presence of a carrier or in absence of a carrier at even higher temperatures.

Dyeings with disperse dyestuffs on Polyamide DuPont Type 472 in general have an inadequate fastness to sublimation, light and washing.

Finally, there is described in U.S. Pat. No. 3,700,405 a process wherein the fibre material is dyed with at least one anionic dyestuff from an acid aqueous dye liquor, at temperatures of 80° to 100° C., preferably at 90° to 100° C., which contains specific organic carriers.

The difficult dyeability is to be attibuted to the relatively low number, and to the relatively difficultly accessible free amino groups, of the polyamide fibres.

The invention is illustrated by the following Examples without being limited by them. The temperatures therein are given in degrees Centigrade, and 'parts' denote parts by weight.

EXAMPLE 1

A polyester textured knitted fabric preheated to 120° is continuously impregnated, through a slop-padding roller, with a dye liquor at 70° consisting of:

(a) 0.3 g of a stock dispersion containing 0.09 g of the yellow dyestuff of the formula

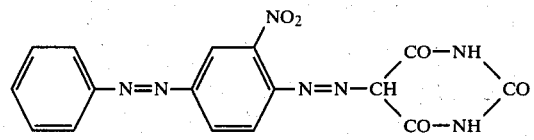

0.09 g of a modified polyvinylpyrrolidone (®Antaron V 216) and 0.12 g of paraffin oil, (b) 0.9 g of a stock dispersion containing 0.27 g of the red dyestuff of the formula

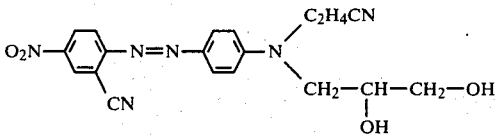

0.27 g of Antaron V 216 and 0.36 g of paraffin oil, (c) 1.8 g of a stock dispersion containing 0.54 g of the blue dyestuff of the formula

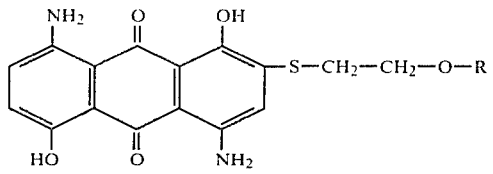

wherein R represents about 70% of H and about 30% of —$CH_2CH_2$—S—$CH_2$—$CH_2$—OH, 0.54 g of Antaron V 216 and 0.72 g of paraffin oil, and (d) 997 ml of perchloroethylene, with a liquor absorption of 250%, relative to the dry weight; and then continuously treated in a suspension loop steamer with perchloroethylene vapour at 135° for 6 minutes. The material leaving the steamer still contains at least 50% of the solvent, calculated on the dry weight, and is subsequently continuously washed in a bath consisting of perchloroethylene and then dried. It is afterwards finished by continuous passage through a saturated steam atmosphere for removal of the perchloroethylene retained by the fibres.

There is obtained a polyester textured knitted fabric evenly dyed medium grey with a very high degree of fixing.

The stock dispersions were prepared as follows: 54 g of the dyestuff is ground with 54 g of Antaron V 216 and 72 g of paraffin oil in a bead(ball)-mill until the particle size is smaller than 3μ. After removal of the grinding agent, there is obtained a 30% liquid dyeing preparation.

EXAMPLE 2

If the procedure is carried out as in Example 1 except that in applying the liquor by slop-padding there is used an absorption of 350%, and the material is vapour-treated at a temperature of 140° instead of at the solvent temperature of 135° given in Example 1, the conditions as described in Example 1 otherwise remaining the same, with the fibre material on leaving the steamer containing at least 50% of the solvent, calculated on the dry weight, then again there is obtained a polyester textured knitted fabric evenly dyed medium grey.

EXAMPLE 3

If the procedure is carried out as in Example 1 except that in applying the liquor by slop-padding there is used an absorption of 150%, and the vapour-treatment is applied at 130° instead of at the vapour temperature of 135° as given in Example 1, then the fabric emerging from the steamer still contains an amount of perchloroethylene of at least 50% calculated on the dry weight. There is obtained a polyester textured knitted fabric just as evenly dyed in the medium-grey shade.

EXAMPLE 4

A mixed fabric made from polyester/wool having a polyester proportion of 60% and a wool proportion of 40% is preheated to 120° and then continuously impregnated, by means of a slop-padding roller, with a liquor at 70° consisting of:

8 g of a stock dispersion containing 2.4 g of the red dyestuff of the formula

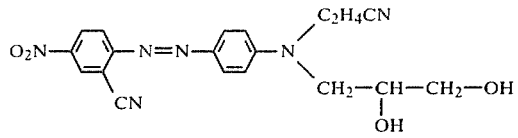

2.4 g of Antaron V 216 and 3.2 g of paraffin oil, and 992 ml of perchloroethylene, and a liquor absorption of 200%; and subsequently continuously treated, in a suspension loop steamer, in a slightly superheated perchloroethylene vapour at a temperature of 125° for 10 minutes. The material leaving the steamer still contains at least 100% of the solvent, calculated on the dry weight.

The material, which emerges from the steamer containing superheated solvent, is steamed, in a second steaming section, on a continuous conveyer belt in saturated steam at 121° for a further 10 minutes, and subsequently continuously washed in perchloroethylene and then dried.

There is obtained a mixed fabric in which the polyester constituent is dyed deep red, while the wool constituent has remained undyed.

EXAMPLE 5

A fabric with a gabardine weave made from polyester, the weft yarn of which consists of a textured polyester yarn and the warp of normal polyester yarn, preheated at 120°, is impregnated by means of a slop-padding roller with a dye liquor at 80° consisting of:

5 g of a stock dispersion containing 1.5 g of the orange dyestuff of the formula

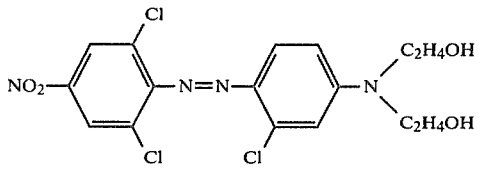

1.5 g of Antaron V 216 and 2 g of paraffin oil, and 995 g of perchloroethylene, with a liquor absorption of 250%; and then vapour-treated, in a continuous steamer as a roller box, in a perchloroethylene atmosphere at 135° for 10 minutes. It can be observed how the material wet with perchloroethylene brings about a formation of vapour during its passage and loses moisture up to its exit from the steamer, without however becoming dry. By means of special vapour superheaters, the temperature in the steamer is maintained at 135° during the entire passage of the material through the steamer.

The resulting level orange dyeing with very good dye penetration of the tightly woven fabric is finished as described in Example 1.

EXAMPLE 6

A heavy taffeta fabric of triacetate is preheated to 120° and impregnated continuously with 300% liquor pick-up by means of a slop pad roller with a liquor having a temperature of 70° and consisting of (a) 5 g of a stock dispersion containing 1.5 g of the yellow dyestuff given in Example 1, 1.5 g of Antaron V 216 and 2 g of paraffin oil;

(b) 0.5 g of a stock dispersion containing 0.15 g of the blue dyestuff given in Example 1, 0.15 g of Antaron V 216 and 0.2 g of paraffin oil; and (c) 995.5 ml of perchloroethylene and subsequently treated for 6 minutes in a loop suspension steamer with superheated perchloroethylene vapours having a temperature of 135°. The material leaving the steamer contains an amount of at least 25% solvent, calculated on the dry weight.

The fabric is then directly treated in a continuous scouring unit with cold perchloroethylene, the material requiring about 6 minutes to run through the unit. After drying, the material is treated continuously for 2 minutes in saturated aqueous steam having a temperature of 100°. A level, lemon-yellow taffeta fabric is obtained which is practically free from perchloroethylene and has a good degree of fixation and uniformity. Furthermore the fabric has a full-handle effect greater than that obtained by dyeing in water.

EXAMPLE 7

A stabilised Qiana ® fabric (DuPont) is preheated to 120° and continuously impregnated, by means of a slop-padding roller, with a dye liquor at a temperature of 80° which consists of:

(a) 2 g of a stock dispersion containing 0.6 g of the yellow dyestuff of the formula

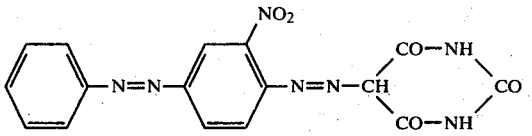

0.6 g of a modified polyvinylpyrrolidone (Antaron V 216) and 0.8 g of paraffin oil, and (b) 0.2 g of a stock dispersion containing 0.06 g of the red dyestuff of the formula

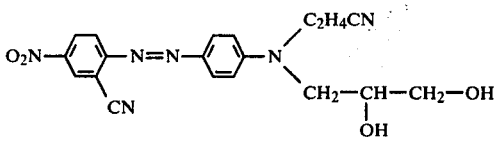

0.06 g of Antaron V 216 and 0.08 g of paraffin oil, and (c) 998 ml of perchloroethylene, and with a liquor absorption of 200%, relative to the dry weight; and then continuously treated, in a suspension loop steamer, with superheated perchloroethylene vapour at 135° for 6 minutes. The material leaving the steamer still contains at least 15% of the solvent, calculated on the dry weight. The material is subsequently washed in a continuous scouring apparatus for perchloroethylene with a solvent temperature of 30°, and then dried. After drying, the material is steamed for 2 minutes in saturated steam at 100° to obtain a material practically free of perchloroethylene.

There is obtained a very well fixed and evenly dyed gold-yellow Qiana fabric.

The stock dispersions were produced as follows: 54 g of the dyestuff are ground with 54 g of Antaron V 216 and 72 g of paraffin oil in a bead mill until the particle size is less than 3μ. The grinding agent is removed to leave a 30% liquid dyeing preparation.

EXAMPLE 8

If the procedure is carried out as in Example 7 except that the material is impregnated with a dye liquor consisting of:

10 g of a stock dispersion containing 1.5 g of the orange dyestuff of the formula

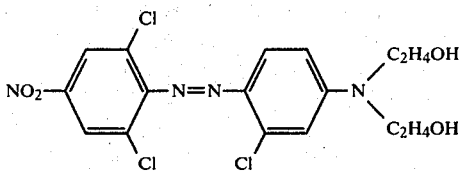

4.5 g of Antaron V 216 and 4 g of paraffin oil, and 990 ml of perchloroethylene, then there is obtained a very well fixed orange Qiana fabric which is evenly dyed and which exhibits a high lustre and a beautiful silk-like handle.

EXAMPLE 9

A fabric with a gabardine weave made from polyester, the weft yarn of which consists of a textured polyester yarn and the warp of normal polyester yarn, preheated at 120°, is impregnated by means of a slop-padding roller with a dye liquor at 80° consisting of:

5 g of a stock dispersion containing 1.5 g of the optical brightener of the formula

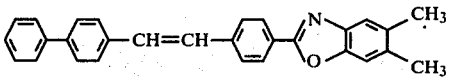

1.5 g of Antaron V 216 and 2 g of paraffin oil, and 995 g of perchloroethylene, with a liquor absorption of 250%; and then vapour-treated, in a continuous steamer as a roller box, in a perchloroethylene atmosphere at 135° for 10 minutes. It can be observed how the material wet with perchloroethylene brings about a formation of vapour during its passage and loses moisture up to its exit from the steamer, without however becoming dry. By means of special vapour superheaters, the temperature in the steamer is maintained at 135° during the entire passage of the material through the steamer.

The resulting optically brightened fabric is finished as described in Example 1. A white material having a highly brilliant white effect is obtained.

EXAMPLE 10

If the process of Example 9 is followed, but using a stabilized Qiana fabric in place of the polyester fabric used in Example 9 and otherwise following the conditions given therein, a white material is likewise obtained having a highly brilliant white effect.

I claim:

1. A process for the continuous dyeing of synthetic textile fibers from organic solvent, comprising the steps of (1) Preheating the textile fibers to at least 100° C.;

(2) Impregnating the preheated textile fibers with a hot halogenated hydrocarbon liquor, containing dyestuff or optical brightener, to form impregnated textile fibers containing between 150 and 300% of liquor, based on the dry weight of the textile fibers; and (3) Immediately passing the preheated and impregnated textile fibers through a vapor zone filled with super-heated vapors of the halogenated hydrocarbon, in such a manner that during passage of the textile fibers through the vapor zone the absorbed liquor becomes concentrated on the textile fibers, whereby (a) the amount of halogenated hydrocarbon on the textile fibers is not increased by condensation of halogenated hydrocarbon vapor, and (b) more than 5% of absorbed liquor is present on the textile fibers when they emerge from the vapor zone, so that the textile fibers during the passage through the vapor zone never become dry.

2. The process of claim 1, wherein the halogenated hydrocarbon is a lower aliphatic chlorinated hydrocarbon, boiling in the range of 70° to 130° C.

3. The process of claim 2, wherein the lower aliphatic chlorinated hydrocarbon is trichloroethylene or 1,1,1-trichloroethane.

4. The process of claim 2, wherein the lower aliphatic chlorinated hydrocarbon is perchloroethylene.

5. The process of claim 4, wherein the superheated vapor is at a temperature in the range of 125° to 145° C.

6. The process of claim 1, wherein the passage of the impregnated textile fibers through the superheated vapor zone takes 1 to 20 minutes.

7. The process of claim 6 wherein the passage of the impregnated textile fibers through the superheated vapor zone takes 3 to 10 minutes.

8. The process of claim 1, wherein the textile fibers are preheated to a temperature of at least 120° C.

9. The process of claim 1, wherein the temperature of the halogenated hydrocarbon impregnating liquor at the time the textile fibers are impregnated therewith is about 80°–90° C.

10. The process of claim 1, further comprising the final step of washing the textile fibers with an organic solvent.

11. The process of claim 1, wherein the dyestuff is a disperse dyestuff.

12. The process of claim 11, wherein the disperse dyestuff is a metal-free mono- or dis-azo dyestuff, a nitro dyestuff, a methine dyestuff, or an anthraquinone dyestuff.

13. The process of claim 1, wherein the optical brightener is a disperse optical brightener.

14. The process of claim 1, wherein the synthetic textile fibers are linear high-molecular polyamide, cellulose-2 ½-acetate, cellulose triacetate, and linear polyester.

15. The process of claim 14, wherein the synthetic textile fibers are polyethylene glycol terephthalate.

16. The process of claim 14, wherein the synthetic textile fibers are of linear high-molecular weight polyamide, containing to the extent of at least 90% by weight the recurring unit of the formula:

(I)

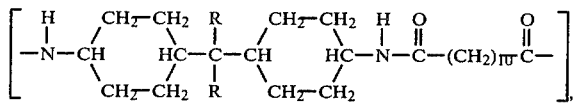

wherein in each cyclohexyl ring one of the hydrogen atom may be substituted by a methyl group and each R is independently hydrogen or methyl.

17. The process of claim 16, wherein all of the cyclohexyl rings are unsubstituted by methyl groups and all of the R-groups are hydrogen.

18. The process of claim 16, wherein the linear high-molecular polyamide fibers have a silk-like handle, a density of 1.04 and a crystallinity similar to that of polyester fibers.

* * * * *